US010213059B2

(12) United States Patent
Ball et al.

(10) Patent No.: US 10,213,059 B2
(45) Date of Patent: Feb. 26, 2019

(54) METHOD OF ASSEMBLING A SHOWER DOOR SEALING ASSEMBLY

(71) Applicant: Kohler Co., Kohler, WI (US)

(72) Inventors: Matthew Joseph Ball, Sheboygan Falls, WI (US); Roque M. Corpuz, Jr., Sheboygan, WI (US); Weerasak Taingtae, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/380,618

(22) Filed: Dec. 15, 2016

(65) Prior Publication Data

US 2017/0095124 A1 Apr. 6, 2017

Related U.S. Application Data

(62) Division of application No. 14/208,859, filed on Mar. 13, 2014.

(60) Provisional application No. 61/785,560, filed on Mar. 14, 2013.

(51) Int. Cl.
*A47K 3/30* (2006.01)
*E06B 3/88* (2006.01)

(52) U.S. Cl.
CPC ..... *A47K 3/302* (2013.01); *A47K 3/30* (2013.01); *A47K 2003/305* (2013.01); *E06B 3/88* (2013.01); *Y10T 29/49826* (2015.01); *Y10T 29/49908* (2015.01)

(58) Field of Classification Search
CPC ..... A47K 3/302
USPC ..... 4/607
See application file for complete search history.

(56) References Cited

U.S. PATENT DOCUMENTS

| | | | | |
|---|---|---|---|---|
| 1,944,440 | A | 1/1934 | Lehman | |
| 2,331,822 | A | 10/1943 | Zechiel et al. | |
| 3,213,584 | A * | 10/1965 | Bush | E04B 1/68 277/641 |
| 3,390,486 | A | 7/1968 | Walters | |
| 3,449,770 | A | 6/1969 | Casebolt | |
| 3,737,921 | A | 6/1973 | Kline | |

(Continued)

FOREIGN PATENT DOCUMENTS

| | | |
|---|---|---|
| CN | 2797561 Y | 7/2006 |
| DE | 29614322 | 10/1996 |

(Continued)

OTHER PUBLICATIONS

European Search Report and Written 14158980.4 dated Jun. 30, 2014; 8 pages.

(Continued)

*Primary Examiner* — Christine J Skubinna
(74) *Attorney, Agent, or Firm* — Foley & Lardner LLP

(57) ABSTRACT

A method of assembling a shower door sealing assembly includes inserting a bumper into a channel that extends along an outer perimeter of at least one vertical side of a door frame having two vertical sides and a horizontal side that extends between the vertical sides. The bumper is coupled to the door frame via a friction fit between the channel and the bumper. The method also includes installing the door frame within a showering enclosure in an orientation in which the vertical sides of the door frame are parallel to a wall of the showering enclosure and the at least one horizontal side is parallel to a floor of the showering enclosure.

18 Claims, 6 Drawing Sheets

(56) References Cited

U.S. PATENT DOCUMENTS

| | | | | |
|---|---|---|---|---|
| 3,854,248 | A * | 12/1974 | Dayus | B21D 53/74 49/465 |
| 3,955,789 | A | 5/1976 | Kline | |
| 4,392,272 | A | 7/1983 | Finkel | |
| 4,715,072 | A | 12/1987 | Sudmann | |
| 4,759,087 | A | 7/1988 | Zeilinger | |
| 4,887,324 | A | 12/1989 | Cairns | |
| 5,023,965 | A | 6/1991 | Reichel | |
| 5,337,425 | A | 6/1994 | Hill | |
| 6,067,672 | A | 5/2000 | Klotz | |
| 6,148,452 | A | 11/2000 | Kirsopp | |
| 6,655,444 | B2 | 12/2003 | Goldenberg et al. | |
| 7,644,453 | B2 | 1/2010 | Dyckow | |
| 2002/0185072 | A1 | 12/2002 | Walpin | |
| 2003/0070221 | A1 | 4/2003 | Goldenberg et al. | |

FOREIGN PATENT DOCUMENTS

| | | | |
|---|---|---|---|
| GB | 2056519 | | 3/1981 |
| WO | WO0234098 | A1 | 5/2002 |
| WO | WO2012037701 | | 3/2012 |

OTHER PUBLICATIONS

DE 296 14 322 A1 English machine translation dated Apr. 12, 2016.
WO 2012/037701 A1 English machine translation dated Apr. 12, 2016.

* cited by examiner

METHOD OF ASSEMBLING A SHOWER DOOR SEALING ASSEMBLY

CROSS REFERENCE TO RELATED APPLICATIONS

This application is a Divisional of U.S. patent application Ser. No. 14/208,859 filed on Mar. 13, 2014, which claims priority to and the benefit of U.S. Provisional Application No. 61/785,560 filed on Mar. 14, 2013. The disclosures of each of these applications are hereby incorporated by reference in their entireties.

FIELD

The present application relates generally to the field of shower doors. More specifically, the present application relates to a bumper that is mechanically coupled to a shower door's frame.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Shower doors must be relatively watertight to prevent water damage and to keep water from spraying or leaking out during a shower. Conventional shower doors may include a watertight seal formed by applying silicone caulk on an inside and/or an outside of the edges of the shower door's wall jambs. A seal applied to the door's edge, may also form the watertight seal, with or without the use of a wall jamb. Alternatively, a seal applied to a wall jamb may also form the watertight seal.

In order to prevent the shower door from slamming shut, bumpers are often installed within a wall jamb, but may also be locally applied to the shower door. The bumpers serve as a stopper that prevents the shower door from hitting the wall jamb. Bumpers may not be aesthetically pleasing, as they protrude from the shower wall, wall jamb, or shower door. In addition, bumpers may fall off, crack or become discolored over time.

SUMMARY

An exemplary embodiment relates to a shower door sealing assembly including a shower door and a bumper. The shower door includes a frame having a channel disposed at an exterior surface of a perimeter of the frame. The bumper is configured to be received in the channel such that the bumper is coupled to the shower door via a friction fit between the channel and the bumper. The channel and the bumper extend along a length of one or more sides of the shower door configured to abut a wall of a showering enclosure. The bumper may be configured to provide a water-tight seal between portions of the shower door along which the bumper extends and surfaces of the showering enclosure or other door assembly components.

Another exemplary embodiment relates to a method of assembling a shower door sealing assembly. A bumper is slid into a channel disposed at an exterior surface of a perimeter of a shower door frame such that the bumper is coupled to the shower door frame. The channel and the bumper extend along a length of one or more sides of the shower door configured to abut a wall of a showering enclosure or a wall jamb disposed on a wall of a showering enclosure.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Figure 7:
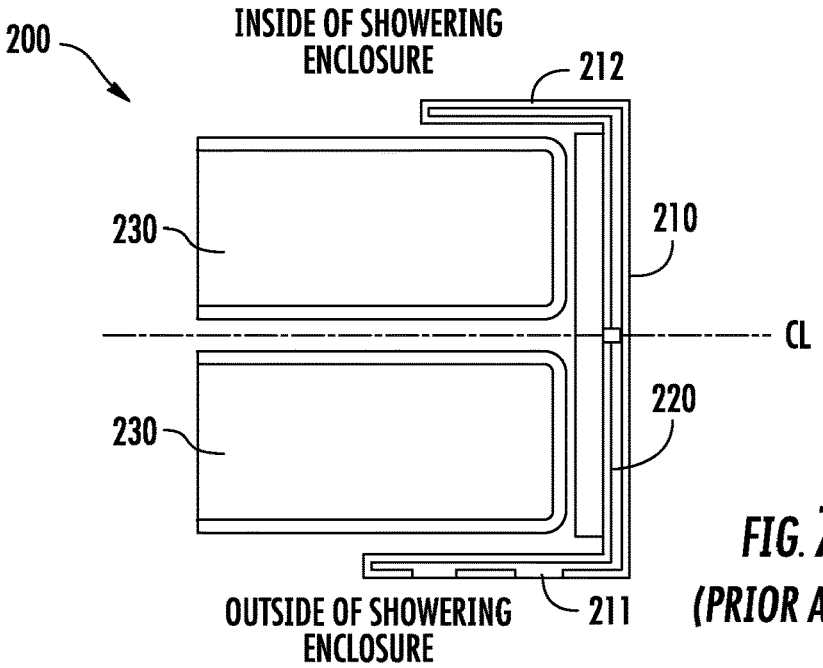
FIG. 7 (PRIOR ART)
FIG. 7 is a top view of a first embodiment of a conventional bumper known in the art.

Referring to FIG. 7, an embodiment illustrating an example of a conventional shower door sealing assembly 200 is shown, in which the assembly 200 includes a wall jamb 210, a bumper 220 and shower door panels 230. The wall jamb 210 is a rigid extrusion, asymmetrical about a centerline CL. A leg 211 of the wall jamb 210 located towards an outside of the showering enclosure is longer than a leg 212 located towards an inside of the showering enclosure. The bumper 220 may be placed locally at a wall connection where the wall jamb 210 is anchored to a wall, or at other points along the wall jamb's length (not illustrated), to prevent the shower door panels 230 from contacting the wall jamb 210 in order to prevent damage to the shower door panels 230. Water is contained within the showering enclosure by an overlap of the wall jamb legs 211 and 212 and the shower door panels 230. In such a configuration, shower door panels 230 that are disposed closer together, disposed closer to the wall jamb 210, and are more overlapped by the legs 211 and 212 of the wall jamb 200 provide better water containment.

Figure 8:
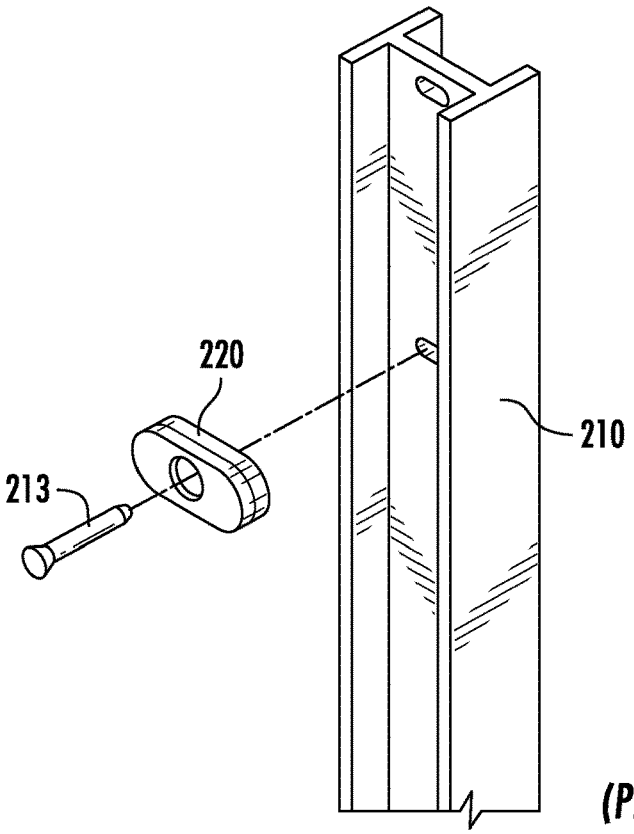
FIG. 8 (PRIOR ART)
FIG. 8 is an illustration of a method of installing the conventional bumper of FIG. 7.

Referring now to FIG. 8, the bumper 220 may be mounted on the wall jamb 210 to provide cushioning for the shower door as it closes. Conventionally, a single bumper 220 is placed locally at a middle of the shower door's opening height or a pair of bumpers 220 is placed at a top and a bottom of both sides of the shower door's opening. If a wall jamb 210 is used, as illustrated in FIG. 8, the bumper 220 is typically installed using the same screws 213 that attach the wall jamb 210 to the wall. Alternatively, the bumper 220 may be chemically adhered to the edges of the shower door panels 230 or attached to the shower door panels 230 with screws (not illustrated) or with localized friction fits.

Figure 9:
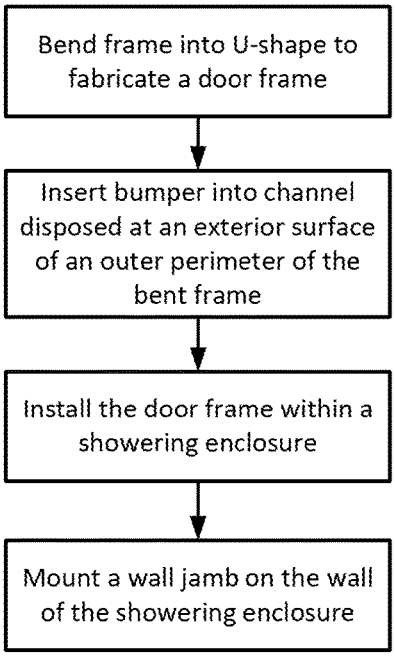
FIG. 9 is a flow chart showing the steps in a method of fabricating/installing a shower door sealing assembly.
Figure 10:
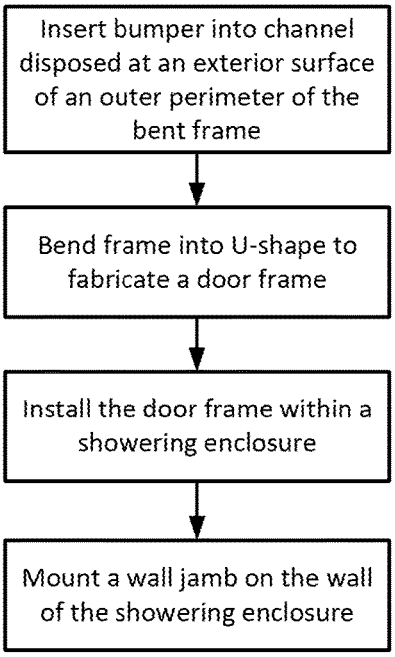
FIG. 10 is a flow chart showing the steps in an alternative method of fabricating/installing a shower door sealing assembly.

Referring generally to FIGS. 1-6F, an exemplary embodiment relates to a bumper that is mechanically coupled to a shower door's frame. The bumper is slid/installed into a channel in the shower door frame before the bumper and frame are bent into a U-shape when the shower door is fabricated (FIG. 10). Alternatively, the bumper may be slid/installed into the channel in the shower door frame after the shower door frame is bent into a U-shape when the shower door is fabricated (FIG. 9). The channel allows the bumper to make a tight connection to the shower door frame and remain attached to the shower door frame's perimeter, even around 90 degree corner joints. This results in the shower door frame having a soft, radiused outside edge rather than a sharp edge with nearly no radius, reducing the possibility of being cut by the corner of the shower door frame.

Figure 1:
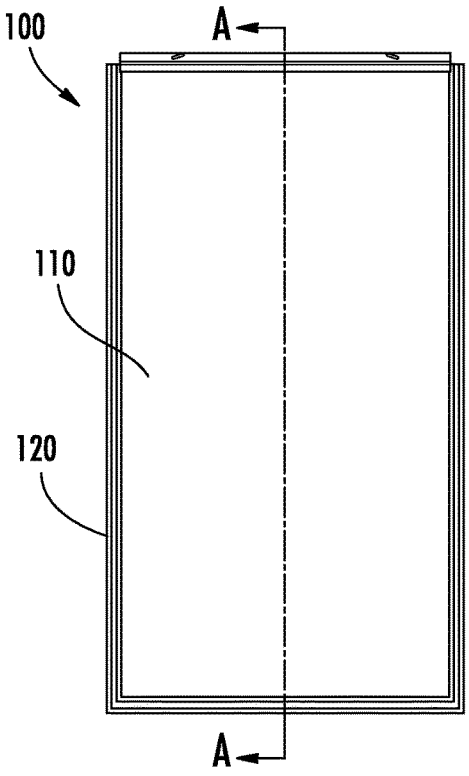
FIG. 1 is a front view of a shower door sealing assembly including a shower door and a bumper that is mechanically coupled to a shower door frame.
Figure 2:
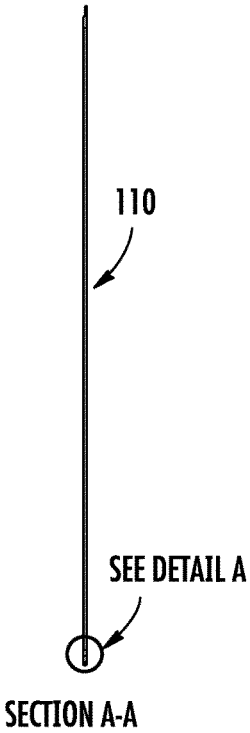
FIG. 2 is a side cross-sectional view of the shower door of FIG. 1 along the line A-A.
Figure 3:
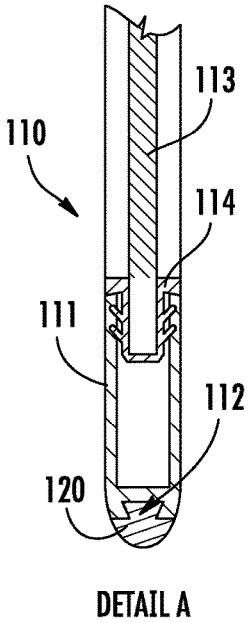
FIG. 3 is a side-cross sectional view of a detail A illustrating the shower door and the bumper of FIG. 1.

Referring to the figures more particularly, as illustrated in FIGS. 1-3, an exemplary embodiment of a shower door sealing assembly 100 includes a shower door 110 and a bumper 120. The shower door 110 includes a frame 111 having a channel 112, disposed at an exterior surface of the shower door 110, along a perimeter of the shower door 110. In an exemplary embodiment, the shower door 110 further includes a glass panel 113 disposed within the frame 111 and connected to the frame 111 via a glazing gasket 114. In other embodiments, the panel 113 may be comprised of other materials such as plexiglass or plastic.

The channel 112 extends along a length of one or more sides of the shower door 110. For example, the channel 112 may extend along a length of one or more sides of the shower door 110 configured to abut a wall of a showering enclosure. Alternatively, the channel 112 may extend along a length of one or more sides of the shower door 110 configured to abut a wall of the showering enclosure and along a width of a bottom of the shower door 110 (i.e., a side of the shower door 110 configured to abut a floor of the showering enclosure). The channel 112 preferably extends along an entire length of either side and the bottom of the shower door 110 in which it is provided. The channel 112 may be symmetrical or asymmetrical (see e.g., FIGS. 5 and 6A-6F) with respect to a horizontal or vertical center line of the channel 112.

In an exemplary embodiment, the bumper 120 is made of a solid, flexible material such as vinyl or rubber having some "give" to it to absorb the impact of the shower door 110 slamming against a wall (not illustrated) of a showering enclosure. Thus, the shower door sealing assembly 100 may also be an impact absorption assembly. The solid, flexible material may also dampen the sound of the shower door 110 slamming against a wall (not illustrated) of the showering enclosure. The bumper 120 extends along a length of one or more sides of the shower door 110. For example, the bumper 120 may extend along a length of one or more sides of the shower door 110 configured to abut a wall of the showering enclosure. Alternatively, the bumper 120 may extend along a length of one or more sides of the shower door 110 configured to abut a wall of the showering enclosure and along a width of a bottom of the shower door 110 (i.e., a side of the shower door 110 configured to abut a floor of the showering enclosure) or other door assembly components. The bumper 120 preferably extends along an entire length of each side of the shower door 110 in which it is provided. The bumper 120 and the channel 112 extend along a same length of the shower door 110.

Figure 11:
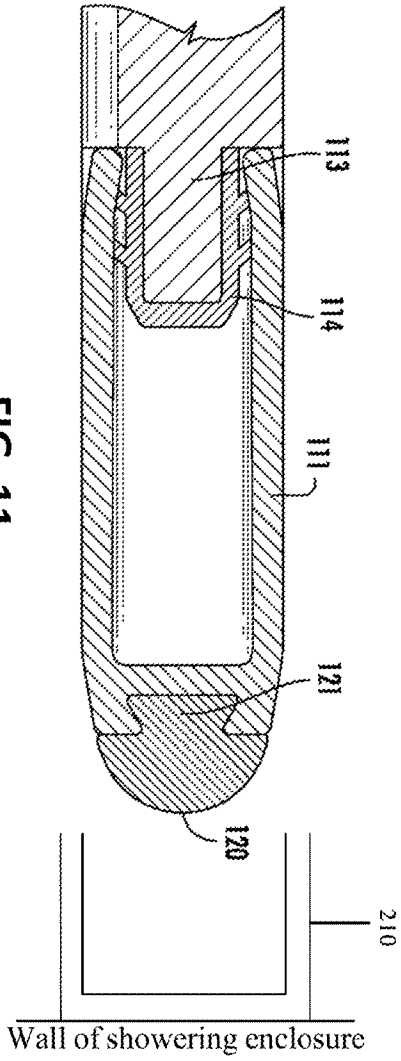
FIG. 11 illustrates a top view of the shower door of FIG. 4 used in conjunction with a wall jamb.

The sole means of water containment along vertical edges of the shower door 110 may be provided by the bumper 120. Alternatively, the bumper 120 may also be used with alternative components to provide a water-tight seal. For example, the bumper 120 may be used in conjunction with a wall jamb 210, as illustrated in FIGS. 7 and 8, but the wall jamb 210 is not required. In one embodiment (FIG. 11), the wall jamb 210 is mounted on a wall of the showering enclosure and is configured to contact and receive the bumper 120 when the shower door 110 is in a closed position (FIGS. 9 and 10). Any known wall jamb 210 may be utilized.

Figure 4:
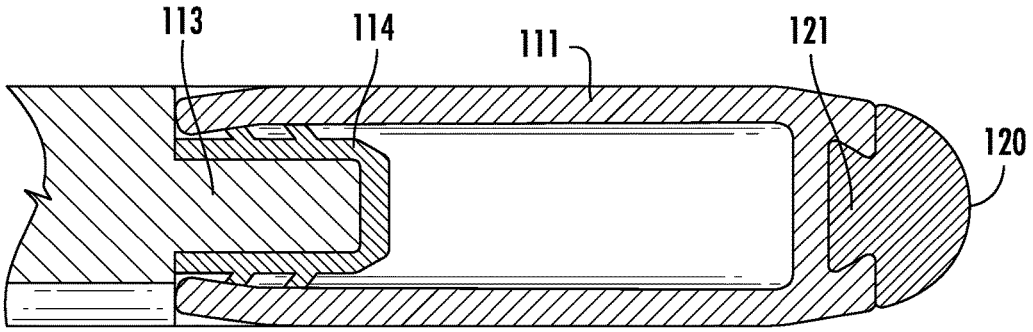
FIG. 4 is a top view of the shower door having the bumper of FIG. 1.
Figure 5:
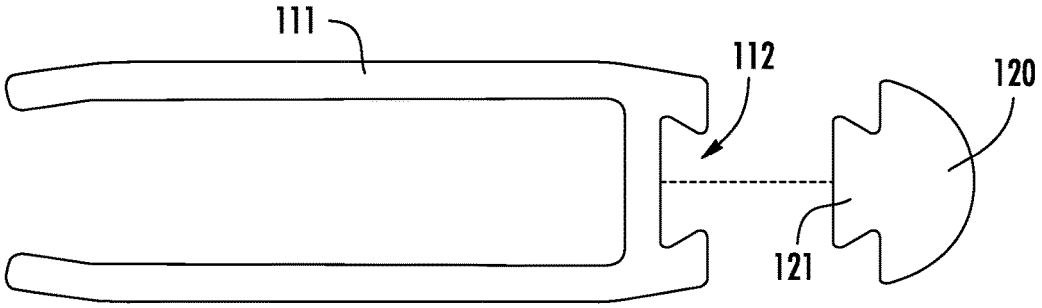
FIG. 5 is an exploded top view of the shower door having the bumper of FIG. 1.
Figure 6A:
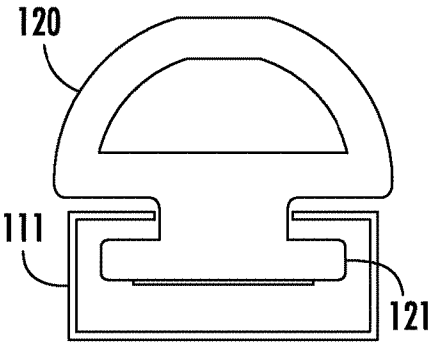
FIGS. 6A-6F are top views of alternative embodiments of shapes for shower door seals formed by a mating of a shower door frame and a bumper, and the geometry required to mate the shower door frame and the coupled bumper.
Figure 6B:
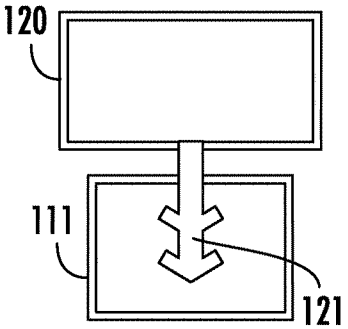
Figure 6C:
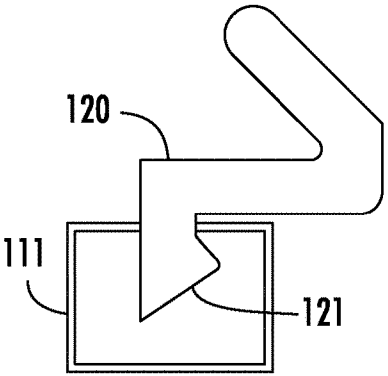
Figure 6D:
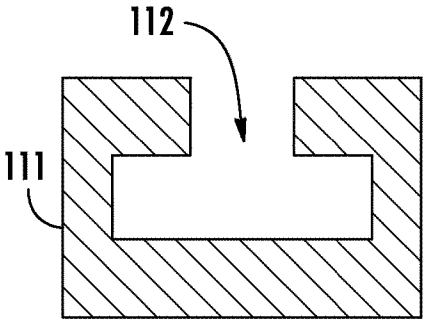
Figure 6E:
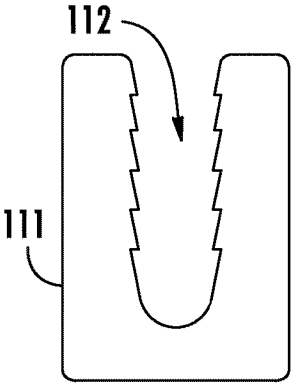
Figure 6F:
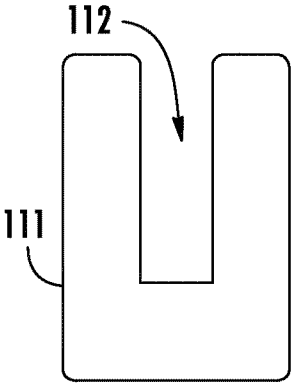

Referring now to FIGS. 4 and 5, the channel 112 and the bumper 120 are mating parts having corresponding shapes and sizes. Specifically, the bumper 120 includes a protrusion 121 corresponding in shape and size to the channel 112. Like the channel 112, the protrusion 121 may be symmetrical or asymmetrical (see e.g., FIGS. 5 and 6A-6C) with respect to a horizontal or vertical center line of the protrusion 121. In an exemplary embodiment, channel 112 and the bumper 120 have corresponding dovetail-like shapes (see FIGS. 1 and 2). In another embodiment, the channel 112 and the bumper 120 may have corresponding T-shapes (see FIGS. 6A and 6D). In yet another embodiment, the channel 112 and the bumper 120 may have corresponding kerf-shapes produced, for example, by extruding or cutting the saw-tooth like shape (see FIGS. 6B and 6E), where a kerf is a divergence between the teeth that protrude left-and-right. Any suitable shape may be utilized, provided the bumper 120 may be mounted within the channel 112 via a friction fit.

The mechanical fit of the bumper 120 to the frame 111 allows for the bumper 120 to be coupled to the frame 111 when the shower door 110 is being assembled. Specifically, to install the bumper 120, the bumper 120 is slid/installed into the channel 112 of the frame 111. The bumper 120 is coupled to the frame 111 via a mechanical, friction fit to give the appearance that the bumper 120 and the frame 111 are one piece. As a result of the mechanical, friction fit, no screws are required to install the bumper 120. Then, the frame 111 and the bumper 120 are bent into a U-shape when the shower door 110 is fabricated (FIG. 10). Alternatively, the bumper 120 may be slid/installed into the channel 112 in the frame 111 after the frame 111 is bent into a U-shape when the shower door 110 is fabricated (FIG. 9). When the bumper 120 is disposed in the channel 112, the bumper 120 makes a tight connection to the frame 111 and remains attached to a perimeter of the frame 111, even around 90 degree corner joints. This results in the shower door 110 having a soft, radiused outside edge (see FIG. 4), rather than a sharp edge with nearly no radius. In an exemplary embodiment, the bumper 120 and the channel 112 cover one or more corners of the shower door 110. This reduces the possibility of being cut by a corner of the frame 111 and provides a user with a more comfortable interaction with the shower door 110. In addition, the bumper 120 may be more aesthetically pleasing to the user in that there are no bumpers projecting from the shower wall or a wall jamb 210.

According to the embodiments described above, an aesthetically pleasing sealing assembly for a shower door is provided. The sealing assembly places a soft, radiused edge around the shower door frame and may serve as a water barrier.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "attached," "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower door sealing assembly as shown and/or described in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A method of fabricating a shower door sealing assembly, the method comprising:

inserting a single bumper into a channel formed within an exterior surface of a frame; and bending the frame having the single bumper inserted into the channel into a U-shape to fabricate a door frame having two vertical sides and a horizontal side that extends between the vertical sides, wherein:

the channel extends along at least one vertical side and the horizontal side of the door frame such that the single bumper is coupled to the door frame via a friction fit between the channel and the single bumper along the at least one vertical side and the horizontal side of the door frame, and the single bumper and the channel cover at least one corner of the door frame formed between the at least one vertical side and the horizontal side.

2. The method of claim 1, wherein the single bumper forms a radiused perimeter adjacent the corner.

3. The method of claim 1, wherein the channel extends along the two vertical sides and the horizontal side such that the single bumper is coupled to the door frame via the friction fit between the channel and the single bumper along the two vertical sides and the horizontal side.

4. The method of claim 1, wherein the single bumper is coupled to the door frame without the use of screws.

5. The method of claim 1, wherein the single bumper is formed of a solid, flexible material.

6. The method of claim 1, wherein inserting the single bumper into the channel comprises mating a protrusion of the single bumper with the channel, the protrusion and the channel having corresponding shapes and sizes.

7. The method of claim 6, wherein both the protrusion of the single bumper and the channel are dovetail-shaped.

8. The method of claim 6, wherein both the protrusion of the single bumper and the channel are T-shaped.

9. The method of claim 6, wherein both the protrusion of the single bumper and the channel are created using a saw such that the shapes of the protrusion and the channel include diverging teeth.

10. The method of claim 1, wherein the shower door sealing assembly has an at least partially radiused perimeter.

11. The method of claim 1, further comprising inserting a panel within an interior surface of the perimeter of the door frame to fabricate a shower door.

12. The method of claim 11, wherein the panel is connected to the door frame via a glazing gasket.

13. A method of assembling a shower door sealing assembly, the method comprising:

inserting a single bumper into a channel formed within an exterior surface of a frame;

bending the frame having the single bumper inserted into the channel into a U-shape to fabricate a door frame having two vertical sides and a horizontal side that extends between the vertical sides; and installing the door frame within a showering enclosure in an orientation in which the two vertical sides of the door frame are parallel to a wall of the showering enclosure and the horizontal side is parallel to a floor of the showering enclosure; wherein:

the channel extends along at least one vertical side and the horizontal side of the door frame such that the single bumper is coupled to the door frame via a friction fit between the channel and the single bumper along the at least one vertical side and the horizontal side of the door frame; and the single bumper and the channel cover at least one corner of the door frame formed between the at least one vertical side and the horizontal side.

14. The method of claim 13, further comprising:

mounting a wall jamb on the wall of the showering enclosure, the wall jamb comprising two legs; and receiving a portion of the single bumper that extends along the at least one vertical side between the two legs of the wall jamb.

15. The method of claim 13, wherein the single bumper forms a radiused perimeter adjacent the corner.

16. The method of claim 13, wherein the channel extends along the two vertical sides and the horizontal side such that the single bumper is coupled to the door frame via the friction fit between the channel and the single bumper along the two vertical sides and the horizontal side.

17. The method of claim 1, wherein the method consists of:

inserting the single bumper into the channel formed within the exterior surface of the frame; and bending the frame having the single bumper inserted into the channel into the U-shape to fabricate the door frame having two vertical sides and the horizontal side that extends between the vertical sides.

18. The method of claim 1, wherein the door frame of the shower door sealing assembly is U-shaped in a final fabricated state thereof.

* * * * *